United States Patent [19]

Laapotti

[11] Patent Number: 4,673,462

[45] **Date of Patent: * Jun. 16, 1987**

[54] PRESS SECTION OF A PAPER MACHINE

[75] Inventor: Jorma Laapotti, Jyväskylä , Finland

[73] Assignee: Valmet Oy, Helsinki, Finland

[ * ] Notice: The portion of the term of this patent subsequent to Jun. 25, 2002 has been disclaimed.

[21] Appl. No.: 702,627

[22] Filed: Apr. 2, 1985

Related U.S. Application Data

[62] Division of Ser. No. 470,197, Feb. 28, 1983, Pat. No. 4,525,241.

[30] Foreign Application Priority Data

Mar. 5, 1982 [FI] Finland ..... 820776

[51] Int. Cl.[4] ..... D21F 3/04; D21F 9/00; D21F 9/02

[52] U.S. Cl. ..... 162/301; 162/305; 162/306; 162/358; 162/360.1

[58] Field of Search ..... 162/305, 300, 358, 360, 162/301, 303, 306, 359, 263, 312, 360.1

[56] References Cited

U.S. PATENT DOCUMENTS

| | | | |
|---|---|---|---|
| 4,075,056 | 2/1978 | Ely et al. | 162/305 |
| 4,192,711 | 3/1980 | Tapio et al. | 162/305 |
| 4,257,844 | 3/1981 | Schmitt et al. | 162/305 |
| 4,525,241 | 6/1985 | Laapotti | 162/358 |

*Primary Examiner*—Steve Alvo

*Attorney, Agent, or Firm*—Steinberg & Raskin

[57] ABSTRACT

A closed press section of a paper machine in which a paper web leaving the wire section of the paper machine is passed, supported by a first upper fabric, through a first double-felted press nip formed by two hollow-faced rolls. The lower fabric in the first double-felted press nip is a second fabric which carries the web forwardly after the first press nip. The press section further includes a smooth-faced central roll against which at least two single-felt nips are formed, the press fabric in the first one of the single-felt nips being constituted by the second fabric. The web is detached from the second fabric and adheres to the face of the smooth-faced central roll and moves along therewith into the next single-felt nip. The press section is devoid of press rolls of the suction type with the first double-felted press nip being formed between two solid-mantle hollow-faced rolls. The run of the lower fabric and web carried thereby is turned downwardly prior to the first single-felt press nip guided by a sector of a roll having a magnitude in the range of about 30° to 160°. The web is passed through the first double-felted press nip and the at least two single-felt nips so that the face of the web which did not contact the forming wire contacts the smooth face of the central roll of the press in the second and third press nips.

11 Claims, 9 Drawing Figures

PRESS SECTION OF A PAPER MACHINE

This is a division of application Ser. No. 470,197, filed 2/28/83, U.S. Pat. No. 4,525,241.

BACKGROUND OF THE INVENTION

The present invention relates to paper machines and, more particularly to press sections of paper machines.

In particular, the present invention concerns a press section of the closed type in which the paper web leaving the wire section of a paper machine is passed, supported by a first upper fabric, through a first double-felted press nip formed by a pair of hollow-faced rolls. The lower fabric in the double-felted press nip comprises a second fabric which carries the web forwardly after the first nip. The paper web is dewatered in the first double-felted press nip through both faces of the web. A smooth-faced central roll is provided with which at least two single-felt nips are formed. The web is arranged in the press section so as to be detached from the second fabric to adhere to the face of the smooth-faced central roll and to move therewith into the next single-felt press nip, the latter being provided with its own press felt.

The starting point for the present invention was a modification of the well known so-called "Sym-Press" press section ("Sym-Press" being a trademark of applicant's assignee Valmet Oy of Finland) on the basis of several years of operating experience with the "Sym-Press" press section.

The "Sym-Press" press section is disclosed in detail in applicant's assignee's Finnish Announcement Publication No. 50,651. In particular, the "Sym-Press" press section is a compact, so-called fully closed press section in which the paper leaving the wire is passed between two felts through a first nip section constituted by a pair of hollow-faced and/or suction rolls, the paper web being dewatered through both faces of the web. The press section includes a smooth-faced roll which is provided with at least one doctor device. A second nip section is formed against the smooth-surfaced roll by one of the two rolls forming the first nip. The web is dewatered in the second nip through the face of the web which faces the second roll of the first nip. In this conventional press section, at least one additional nip is provided after the second nip, the additional nip being formed between the smooth-faced central roll, whose diameter is greater than the diameters of the other press rolls in the press section, and a hollow-faced roll, a felt passing through the additional nip. The additional nip is situated substantially diametrically opposite the second nip with respect to the central roll.

With respect to the prior art relevant to the present invention, reference is also made to U.S. Pat. No. 4,257,844 as well as to the articles published in the journals Das Papier, Heft No. 1, pages 33–34, 1981, and Norsk Skogindustri, No. 3, page 80, 1974.

In the latter publications, a modification of the "Sym-Press" press section described above is disclosed in which the "Sym-Press" suction roll does not form a nip with the smooth-faced central roll and wherein, either in connection with or prior to the suction roll, the first double-felted press nip of the press section is arranged in which the removal of water takes place in two directions. In lieu of the "Sym-Press" suction roll, a hollow-faced press roll is situated in connection with the smooth-faced central roll to form the second press nip of the press section. The third press nip is formed substantially on the opposite side of the smooth-faced central roll relative to the second nip. In the known press sections described above, it has been necessary to use a suction roll either as a press roll or as a roll within whose area the web supported by the pick-up felt changes its direction upwardly towards the second nip. The use of a suction roll or a corresponding suction device results in considerable drawbacks in the operation of the press section or which are discussed below in greater detail.

The perforations in a suction roll are known to leave a marking on the web which of course is detrimental to the appearance of the paper and which may affect its surface properties. Suction rolls are expensive and require their own drive motors and control systems and are quite noisy. Suction rolls consume large quantities of air since in addition to the air which passes through the web and the felt, air also enters into the suction system which arrives at the suction zone in the holes or perforations in the suction roll mantle during each revolution of the roll. Moreover, the water seals of the suction box of the suction roll can cause difficulties during operation.

In particular, as is known, a suction roll comprises a rotating cylindrical perforated mantle and a stationary axial suction box situated within the cylindrical mantle and which is sealed to the inner face thereof. The.suction width of the suction box is, for example, 100 to 500 mm and the suction box extends from one end of the mantle to the other. The suction box is connected to a suction system so that an airflow is produced through the holes in the area of the mantle which faces the suction box at any particular time during rotation of the roll. It can be seen from the foregoing that suction rolls are relatively expensive components of paper machines. For example, the drilling of the perforations in the mantle is a difficult and expensive job and the perforations inherently reduce the strength of the mantle thereby making it necessary to use special metal alloys in the construction of the rolls and relatively high thicknesses for the mantle which results in high material costs.

As noted above, the quantity of air situated within the holes in the suction roll passing into the suction zone to enter into the suction system is surprisingly high in the case of modern, high-speed paper machines. With higher speeds of the paper machine, greater amounts of "hole-air" enter the suction system. The proportional amount of "hole-air" is further increased by the fact that when the speed of the machine is increased, the rolls must be made even stronger, such as by increasing the thickness of the mantle. Of course, increasing the thickness of the mantle proportionally increases the quantity of hole-air carried into the suction system. As also noted above, an additional drawback inherent in suction rolls is the high noise created during their operation.

Especially in the case of suction rolls used as press rolls, it is often necessary to arrange for a variable crown for the roll. However, this is usually not possible since the mantle of a suction roll is perforated and/or since the interior of the roll is occupied to such an extent by the suction box that no devices for varying the crown can be fitted within the interior of the mantle. It of course would be desirable to eliminate this drawback.

As noted above, a suction roll and, in particular, a press suction roll, is a highly expensive component of a press section of a paper machine.

SUMMARY OF THE INVENTION

Accordingly, it is a main object of the present invention to provide a new and improved press section which is devoid of suction rolls and, in particular, which is devoid of press rolls of the suction type.

Another object of the present invention is to provide a new and improved press section wherein the noise created during its operation is significantly reduced relative to conventional press sections.

It is a further object of the present invention to provide a new and improved press section of a paper machine and through which a web can be passed in a reliable manner over a closed path without the risk of breakage.

A still further object of the present invention is to provide a new and improved press section which retains all of the advantageous characteristics of the "Sym-Press" press section.

Reference is further made with respect to related prior art technology to U.S. Pat. No. 4,192,711, assigned to applicant's assignee, wherein a method is disclosed for detaching a paper web from the forming wire in a paper machine and for passing the web in a so-called closed passage into the press section wherein a dewatering pressing operation is performed. In this method the web is passed around a relatively large sector of a grooved and/or perforated roll situated within a felt loop. A vapor treatment is directed at the web over the roll sector around which the web is guided by means of which the web, and possibly the felt located underneath the web on the roll, are heated and the web supported from outside as its direction is changed. The heated web is then passed on the felt into the first press nip wherein it is pressed between a hollow-faced roll and a smooth-faced roll for dewatering.

It is another object of the present invention to further improve aspects of the method disclosed in U.S. Pat. No. 4,192,711.

It is a particular object of the invention to provide a press section which comprises at least three press nips through which the web is passed without any open run and in which press section there is no need for a suction roll to be used in any press nip. This is especially advantageous in the case of wide paper machines in which high press loads are used.

Another objective of the present invention is to provide a closed paper machine press section by means of which improved technical characteristics of the paper produced are achieved, the most important of which being the achievement of a balancing in the distribution of fillers and fines in the paper through the selection of dewatering directions in the press in view of the principal draining direction in the former section of the paper machine.

Another object of the present invention is to provide a new and improved press section including a smooth-faced central roll such as a granite roll, which is loaded in an advantageous manner. This is particularly desirable in the case of wide paper machines.

Another particular object of the present invention is to provide a press section of the type described above in which, even where a suction roll is employed, there is no need for such suction roll to be loaded with high press nip rolls. In this manner, detrimental marking of the paper by the suction roll is avoided.

Briefly, in accordance with thc present invention, these and other objects are attained by providing a press section in a paper machine which includes a first upper fabric on which a paper web from a forming wire of a wire section of the machine is carried, a first double-felted press nip constituted by two hollow-faced rolls through which the first upper fabric and web pass, the second lower fabric passing through the first press nip so that the web is dewatered in the first press nip through both of its faces. A smooth-faced central roll is provided which constitutes one roll of at least two single-felt nips. The web is carried after the first press nip by the second lower fabric which constitutes the single felt of a first one of the at least two single-felt nips formed with the smooth-faced central roll. The web is detached from the second lower fabric and adheres to the face of the smooth-faced central roll to move therewith into a next one of the single-felt nips.

The press section is devoid of press rolls of the suction type, the hollow-faced rolls which constitute the first double-felted press nip being solid-mantle hollow-faced rolls.

Prior to passing into the first one of the at least two single-felt press nips, either after or before the first double-felted press nip, the run of the second lower fabric and web supported thereby is turned in a downward direction guided over a sector of a suction roll or hollow-faced press roll which is situated within the loop of the second lower fabric and over a certain sector having a magnitude within the range of about 30° to 160°.

Moreover, the web is passed through the double-felted press nip and the at least two single-felt nips such that the face of the web which did not contact the forming wire of the wire section of the paper machine, i.e., the side of thec web opposite from the side which laid against the forming wire, contacts the smooth face of the central roll of the press in the single-felt press nip.

It will be understood that the terms "press fabric" and "press felt" as used herein mean all felt-like products, whether made of artificial or natural fibers, which are commonly used in paper machines, especially in the press sections of paper machines, either in order to promote drainage of water from the web or to carry the wet web from one processing step to the next.

Several important and practical advantages are obtained by the present invention as will be discussed below in greater detail. The press section of the present invention makes it possible to transfer the paper web through at least three press nips without any open passage and without any suction roll being loaded with press nip type pressures. As noted above, especially in the case of wide paper machines having high press loads, a loaded suction roll has proven to be unreliable from the viewpoint of strength.

By means of a press section in accordance with the present invention, it is possible to remove most of the water from the web in a "downward" direction making it possible to correct any asymmetry of the paper web which might occur in cases where fillers and/or fines have been washed on the wire portion of the machine to a greater extent from the bottom face of the web. Moreover, the fines can be shifted along with the water from the upper facc of the web in a downward direction while still being retained within the web under the effect of the felts.

A favorable loading of the smooth-faced central roll is possible in the press section of the invention since the directions of the second and third press nip are such that the press loads as well as the load of the weight of the central roll substantially compensate each other.

Certain embodiments of the present invention disclosed herein utilize a suction roll. However, it is important to note that in such embodiments, the suction roll is not loaded by means of high nip loads so that suction-roll marking of the web will not occur to any significant extent.

DESCRIPTION OF THE DRAWINGS

A more complete appreciation of the present invention and many of the attendant advantages thereof will be readily understood by reference to the following detailed description when considered in connection with the accompanying drawings, the invention not being limited to the details of the illustrated embodiments, wherein.

DESCRIPTION OF THE PREFERRED EMBODIMENTS

Figure 1:
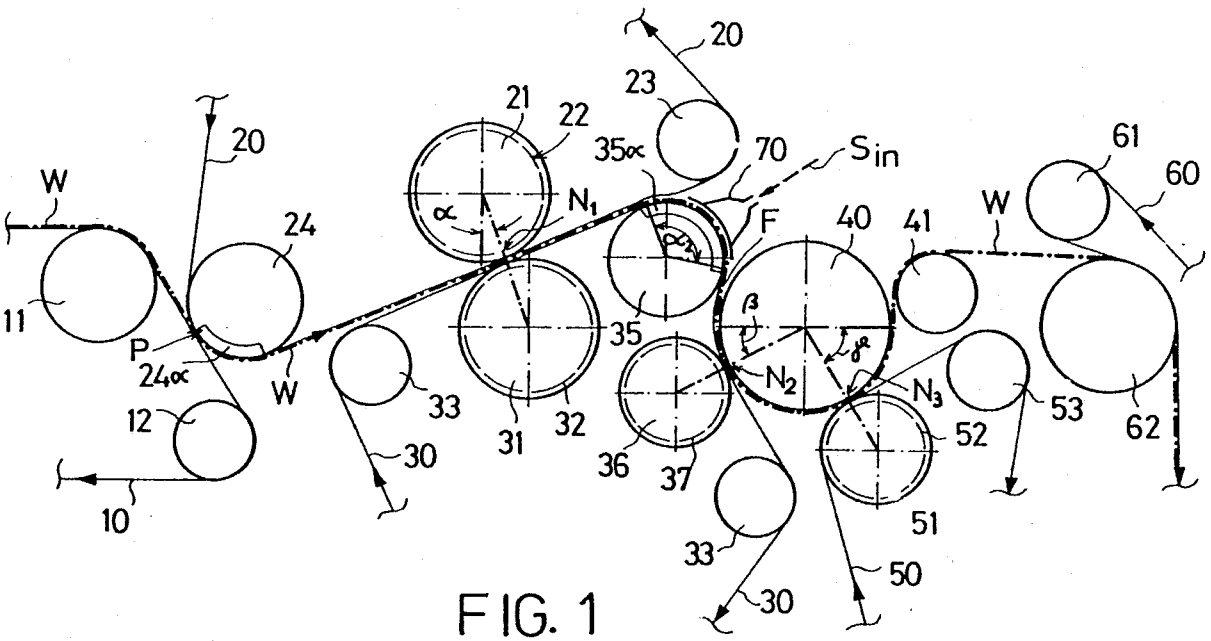
FIG. 1 is a schematic elevation view of a first embodiment of a press section in accordance with the present invention.

Referring now to the drawings wherein like reference characters designate identical or corresponding parts throughout the several views, the features which are common to the various disclosed embodiments of the invention will first be described. The paper web W is transferred onto the first felt 20 at the beginning of a suction zone 24$\alpha$ of the pick-up roll 24 at a detaching point P on the run of the wire-section fabric or wire 10 between the rolls 11 and 12. The web W adheres to the lower face of the first felt 20 by means of the suction zone 24$\alpha$ and is thereby transferred into the first press nip $N_1$. The first press nip $N_1$ is formed between the upper roll 21 and the lower roll 31. The first press nip $N_1$ is double-felted with the first and second felts 20 and 30 passing therethrough so that the pressing of the web in the first nip takes place between the first felt 20 and the second felt 30. The rolls forming the first press nip $N_1$, namely rolls 21 and 31, are provided with hollow faces 22 and 32, respectively. For example, these rolls may be, for example, grooved rolls, blind-drilled rolls, or combinations thereof, e.g., a grooved roll and a blind-drilled roll.

Figure 2A:
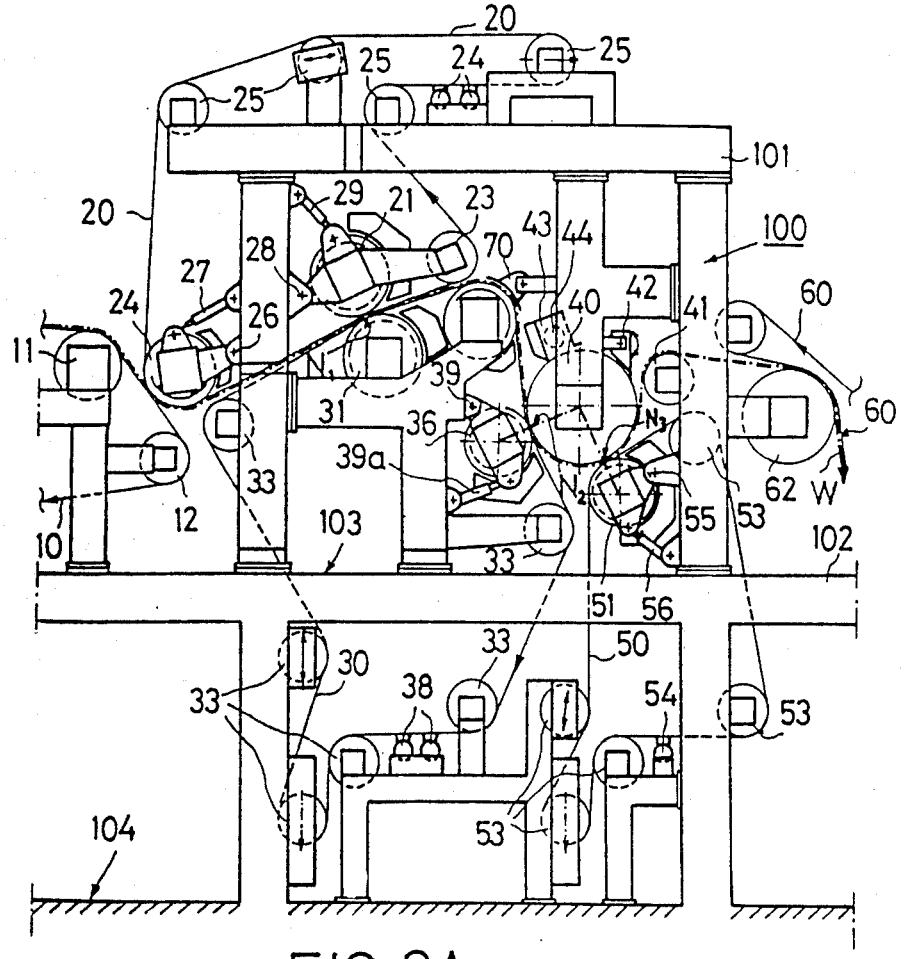
FIG. 2A is an elevation view of a second embodiment of a press section in accordance with the present invention, the frame construction of the press section being illustrated.
Figure 2B:
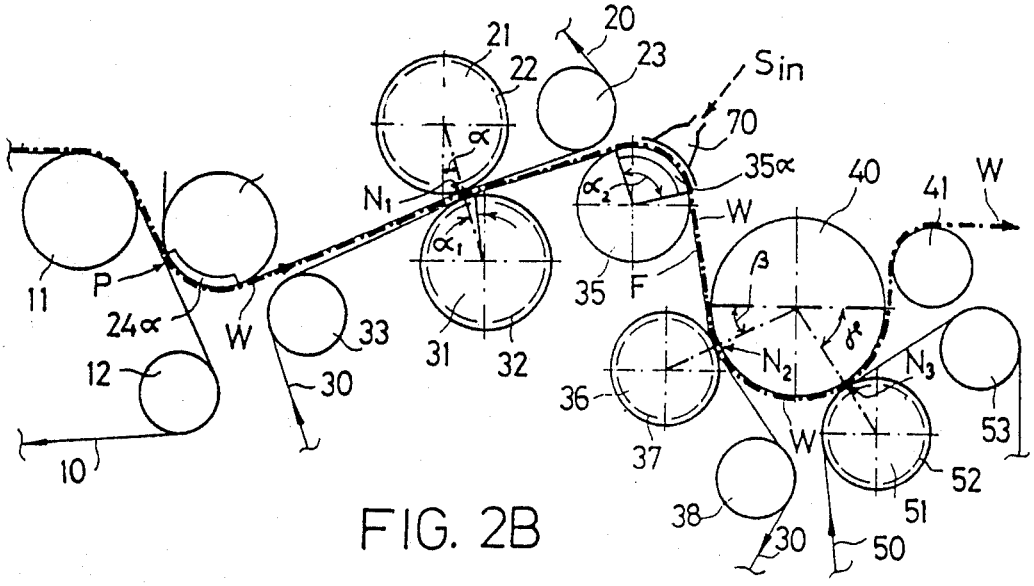
FIG. 2B is a schematic elevation view of the press section illustrated in FIG. 2A with the frame construction omitted.
Figure 3:
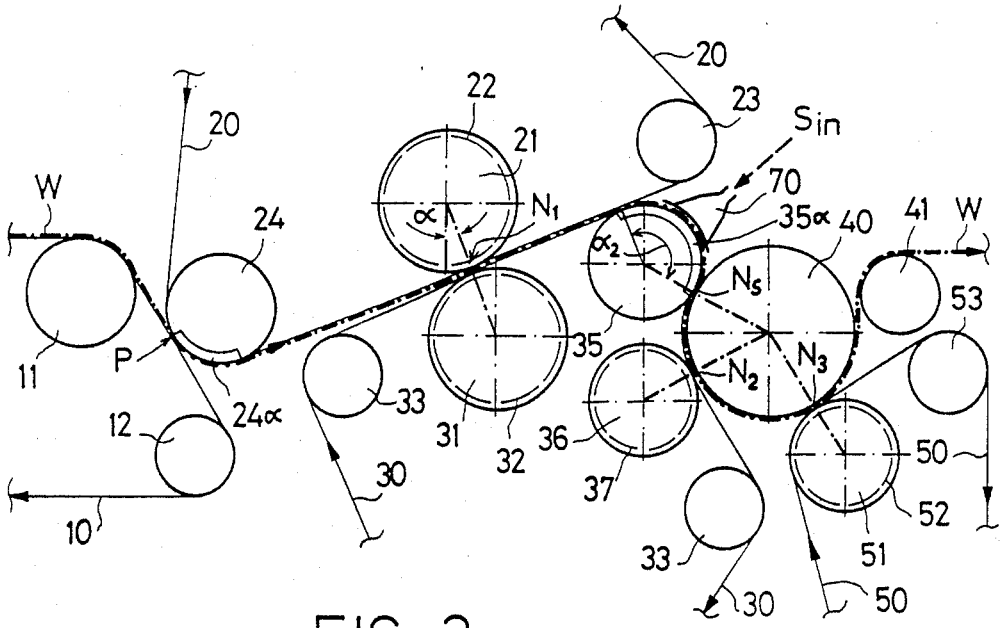
FIG. 3 is a schematic elevation view of a third embodiment of a press section in accordance with the invention in which a suction roll is situated within the loop of a second fabric to form with a smooth-faced central roll a transfer nip having a light loading.
Figure 4:
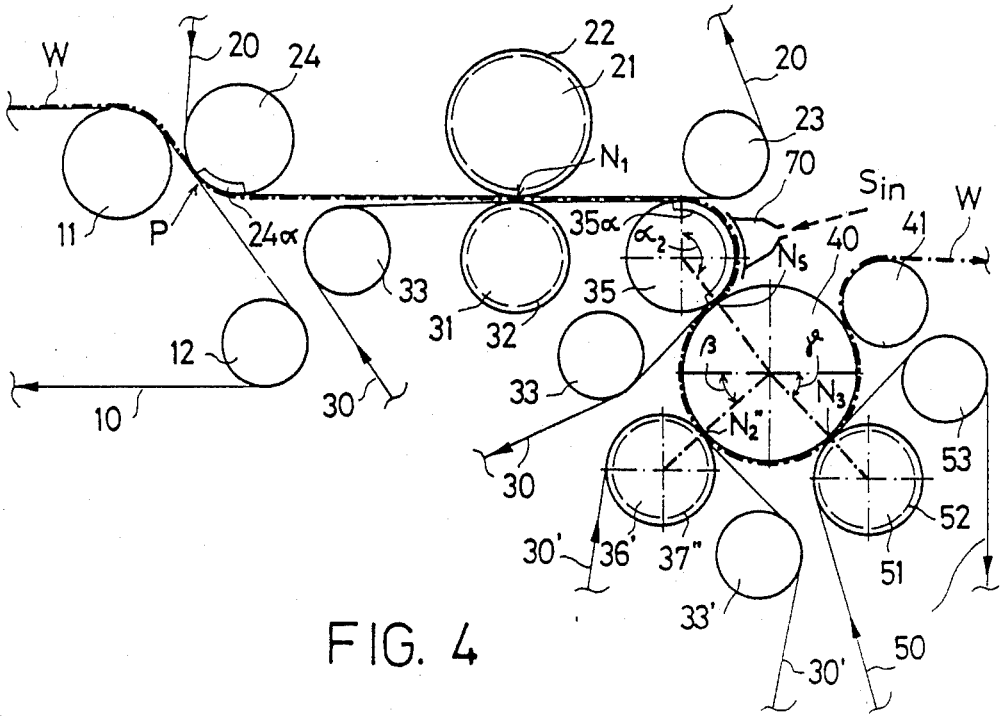
FIG. 4 is a schematic elevation view of a modification of the embodiment of the invention illustrated in FIG. 3 in which a joint run of the first and second fabrics after the pick-up point of the web is substantially horizontal.

In accordance with the embodiments illustrated in FIGS. 1, 3 and 4, the paper web W is transferred from the first press nip $N_1$ sandwiched between the felt 20 and 30 to the suction sector 35$\alpha$ of a suction roll 35. In the embodiment illustrated in FIG. 5 the web is transferred from the first press nip onto a hollow-faced roll 35'. In accordance with the embodiment illustrated in FIGS. 2A and 2B, the web is transferred from the first press nip $N_1$ on the face of the lower felt 30 to the suction sector 35$\alpha$ of the suction roll 35. In the embodiment of FIG. 6, the web is transferred from the first press nip on the lower felt 30 onto the hollow-faced roll 35' and in accordance with the embodiments illustrated in FIGS. 7 and 8, the web is transferred from the first press nip on the lower felt 30 straight into a second press nip (which constitutes a first single-felt press nip).

The press section includes a smooth-faced central roll 40 in connection with which at least two single-felt nips are formed, each of the embodiments illustrating at least two such single-felt nips which constitute second and third press nips of the press section. Thus, the second and third press nips $N_2$, $N_3$; $N_2'$, $N_3$; $N_2''$, $N_3$, form a press having a compact construction with the smooth-faced central roll 40. The central roll 40 preferably has a larger diameter than the other press rolls 36, 51 and 81 cooperating therewith so that sufficient space is obtained for the nips and for the other equipment associated with the central roll. The central roll 40 may advantageously comprise a granite roll which is advantageous in that the web W to be compressed will have a stronger adhesion to the face of the roll 40 than to a felt and yet the web W can be readily detached from the face of a granite roll under the effect of a speed differential when the web W is conducted from the press section into the drying section.

Referring in particular to the embodiment illustrated in FIG. 1, a small space F is provided between the suction roll 35 and the central roll 40, the web W passing over the space F supported by the second fabric 30. The second nip $N_2$ is formed at an angular distance $\beta$ with respect to a horizontal plane passing through the axis of the smooth-faced central roll 40. The second press nip $N_2$ is formed by the central roll 40 and the hollow-faced press roll 36, the hollow face thereof being designated 37. The second felt 30 passes through the second nip $N_2$.

In a similar manner, the third press nip $N_3$ is formed at an angular distance $\gamma$ preceding the horizontal plane which passes through the axis of the central roll 40. The third nip $N_3$ is formed by the central roll 40 and a hollow-faced press roll 51, the hollow face thereof being designated 52. The third nip $N_3$ has its own felt 50 which passes through the third nip $N_3$ and guided by the guide rolls 53. Furthermore, in accordance with the embodiment of FIG. 1, the web W is detached from the face of the central roll 40 and is guided by guide roll 41 onto the first drying cylinder 62 against which the web W is pressed by the drying fabric 60 guided by guide roll 61.

Referring to the embodiments of FIGS. 2A, 2B, 6, 7 and 8, the paper web W is made to follow the second felt 30 after passing through the first press nip $N_1$ by means of a so-called felt covering, i.e., the lower second felt 30 follows the lower press roll 31 over a certain angle $\alpha_1$. The second felt 30 carries the web W onto the face of the suction roll 35 in the case of the embodiments of FIGS. 1–4 or onto the hollow-faced roll 35' in the case of FIGS. 5 and 6 and the web adheres to the face of the central roll 40 such that the face of the web which contacted the first or upper felt 20, i.e., the upper face of the web W on the forming fabric, contacts the smooth face of central roll 40. This is an important feature of the invention for achieving advantageous technical properties of the paper with respect to the distribution of fillers or fines.

According to the embodiments of FIGS. 1 and 2A, 2B, the suction roll 35 is spaced from the central roll 40 at an appropriate distance F. In the embodiments of FIGS. 3 and 4, the suction roll 35 forms a transfer nip $N_s$ with the central roll 40, the transfer nip having a relatively small loading. In the embodiment illustrated in FIG. 4, the felt 30 does not follow the web W into the second press nip $N_2$, but , is separated from the web W substantially immediately after passing through the transfer nip $N_s$. In this case, it is necessary to use a reasonable and adequately high line pressure in the transfer nip $N_s$, e.g., about 10 to 30 kN/m,in order to assure that the web W adheres to the smooth face of the central roll 40.

In the second press nip $N_2$, $N_2$, of the embodiments of FIGS. 1–3 and 5–7, the web W is pressed between the second fabric 30 and the central roll 40 by means of a roll 36 (FIGS. 1–3 and 7) or a roll 35' (FIGS. 5 and 6), rolls 36, 35' being provided with a hollow face 37, 37', respectively. On the other hand, in the embodiment of FIG. 4, the second fabric 30 only passes through the first press nip $N_1$ while the second press nip $N_2''$ has its own press fabric 30', the second nip $N_2''$ being formed between the central roll 40 and the hollow-faced press roll 36' having a hollow face 37''. The felt 30' is guided by a guide roll 33'.

Figure 5:
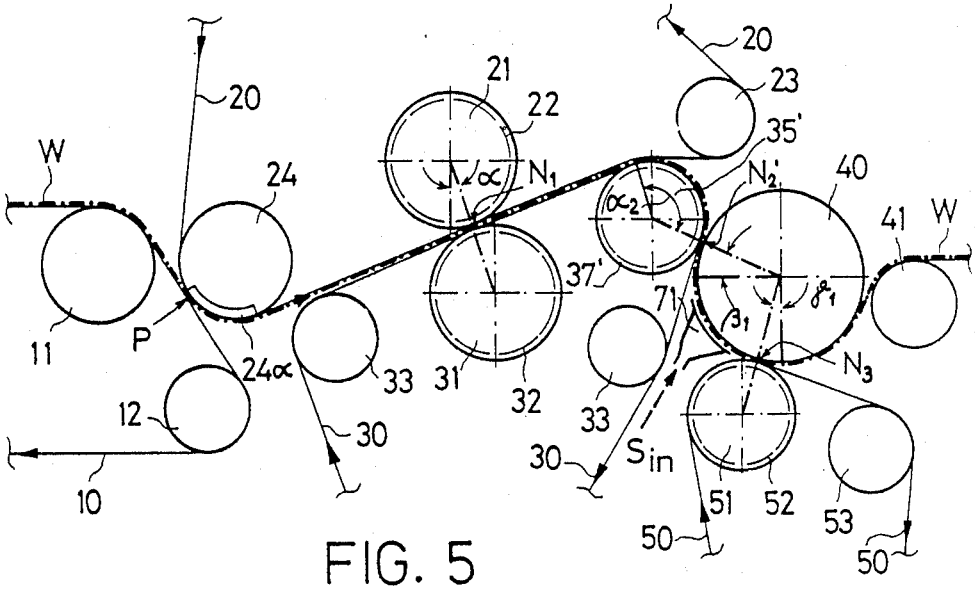
FIG. 5 is a schematic elevation view of another embodiment of a press section in accordance with the invention in which a steam box is fitted between the second and third nips.
Figure 6:
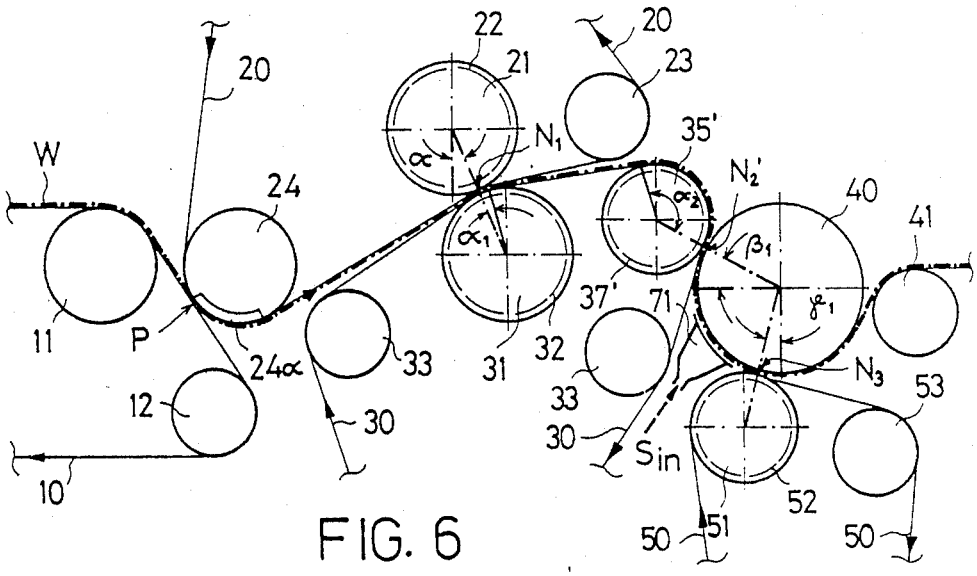
FIG. 6 is a schematic elevation view of yet another embodiment of a press section in accordance with the present invention wherein the second fabric has in the first separate double-felted nip a certain covering angle with respect to the lower roll.

According to the embodiments of FIGS. 5 and 6, hollow-faced roll 35', over a sector of which the web supported by the second felt 30 is turned downwardly in its running direction, forms the press nip $N_2'$ with the central roll 40. This nip $N_2'$ is located at an appropriately small angle $\beta_1$ from a horizontal plane passing through the axis of the central roll 40. Correspondingly, the third press nip $N_3$ is situated at a small angle $\alpha_1$ ahead of the vertical plane passing through the axis of the central roll 40.

Figure 8:
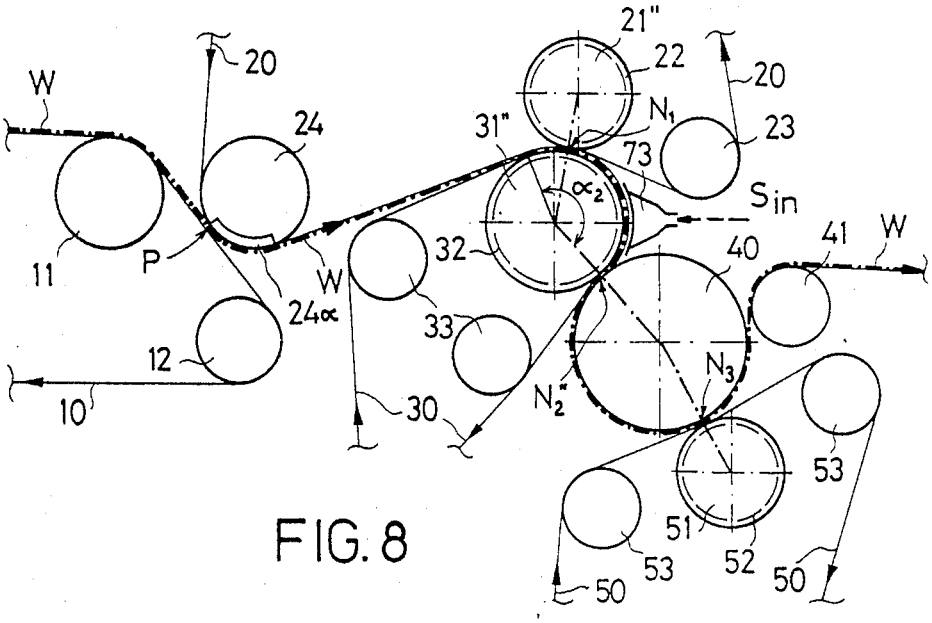
FIG. 8 is a schematic elevation view of yet still another embodiment of a press section in accordance with the invention wherein the lower press roll forming the first press nip also forms a press nip with the smooth-faced central roll of the press section.

The embodiment of the invention illustrated in FIG. 8 utilizes the principles of the present invention even though the first press nip $N_1$ in this embodiment is not a separate nip but, rather, is formed by the two hollow-faced rolls 21'' and 31'', of which the lower press roll 31'' also forms the second press nip $N_2''$ with the central roll 40. In this manner, a particularly compact press construction is obtained which is devoid of any loaded suction roll. As seen in FIG. 8, the nips $N_2''$ and $N_3$ are located substantially at diametrically opposed sides of the middle roll 40, such loading of the central roll 40 being advantageous with respect to the line pressures of the nips $N_2''$ and $N_3$.

According to the embodiments of FIGS. 1, 2A, 2B, 3, 5 and 6, after the pick-up roll 24, the run of the first fabric 20 and, similarly, the run of the second fabric 30 after the guide roll 33, are directed at an upwardly inclined angle $\alpha$. This results in the first press nip $N_1$ also being inclined at a corresponding angle with respect to the vertical plane. The magnitude of the angle $\alpha$ is, for example, in the range of about 20° to 60°. In this manner, the construction of the press section is as compact as possible. On the other hand, in the embodiment of FIG. 4, the run of the fabrics 20 and 30 is substantially horizontal at the first press nip $N_1$. A downwardly slanting run of the fabric 20 and 30 within the region of the nip $N_1$ may also be employed in certain special cases.

According to an important feature of the invention, the web W is diverted or turned downwardly in the machine direction while supported by the second fabric 30 to carry the web through the nips formed by the smooth-faced central roll 40. The angle through which the second fabric and web supported thereby is diverted or turned downwardly is designated $\alpha_2$ in the various figures. The magnitude of this angle is commonly within the range of about 30° to 160° and, most preferably, about 90° to 150°, so as to obtain a compact construction. By this feature, with reference to the conventional "Sym-Press" press section described above, a sort of "inverted" press section is obtained. From the viewpoint of the operation of this press section, it is important that the side of the web which did not contact the forming wire 10 will lie against the smooth-faced central roll 40 in the press. By such inversion of the web, the dewatering direction obtained in the second and third nips will be towards the felts 30 and 50, i.e., away from the smooth-faced roll 40. Accordingly, by means of this dewatering direction which is in the direction of the thickness of the web, the fillers and/or fines can be caused to move along with the water being expressed in the dewatering direction whereby the possible unequalsidedness of the fillers resulting from the washing of the fillers from the web face facing towards the forming wire 10 will be compensated for.

The dewatering of the web in a press section in accordance with the invention can be intensified by means of the provision of one or more steam boxes. Moreover, one or more steam boxes may be utilized in order to keep the web on the face of the fabric carrying the web, such as against the effects of centrifugal forces. In this connection, with reference to the embodiment illustrated in FIG. 1, the steam box 70 is situated over the suction sector 35α of the suction roll 35, a suitable space being available therefor. The supply of steam into the box is illustrated schematically by means of the arrow $S_{in}$. In the embodiments of FIGS. 2A, 2B, 3 and 4, the steam box 70 is in a corresponding position which is advantageous in that the steam supply through the box 70 can be made to penetrate into the web by means of the suction effect of the roll 35. The steam supplied by the steam box 70 intensifies the dewatering in the subsequent nips $N_2$ and $N_3$ in a known manner. According to the embodiments of FIGS. 5 and 6, the steam box 71 is situated between the second press nip $N_2'$ and the third press nip $N_3$ over the central roll 40. The steam supplied by the steam box 71 intensifies the dewatering in the third nip $N_3$.

Figure 7:
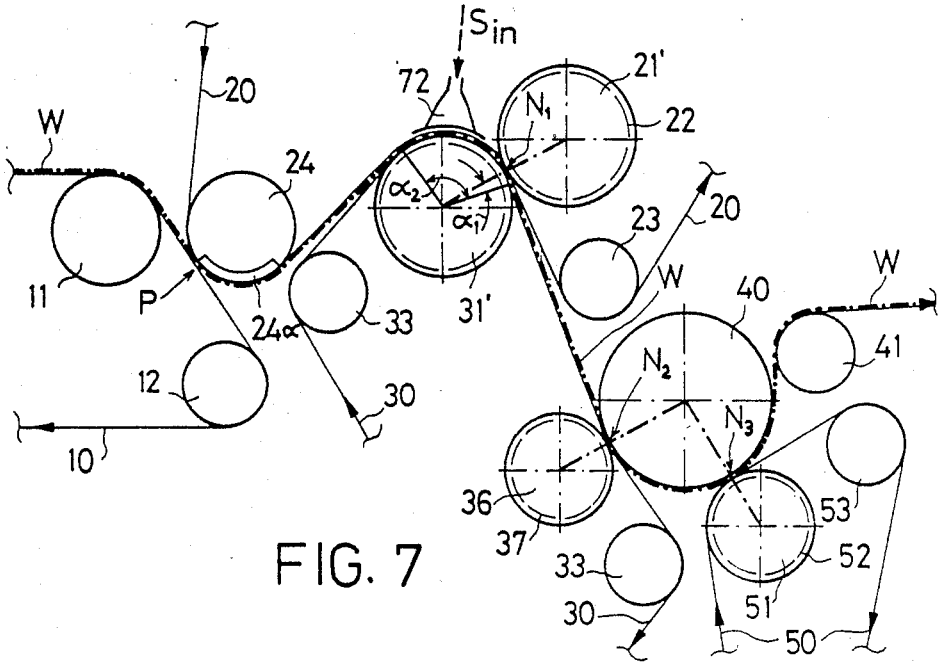
FIG. 7 is a schematic elevation view of still another embodiment of a press section in accordance with the present invention wherein the first and second fabrics are guided over a considerable sector of the lower roll of the first double-felted nip prior to passing through the first press nip.

According to the embodiment of FIG. 7, a steam box 72 is arranged prior to the first press nip $N_1$ against the roll 31' within the sector in which the web W is in compression between the first felt 20 and the second felt 30. In the embodiment of FIG. 8, a steam box 73 is arranged after the first nip $N_1$ against the press roll 31'' prior to the second nip $N_2''$. The steam boxes 72 and 73 are in advantageous positions in that they are situated against a roll having a hollow face 32 so that the steam can penetrate into the felts 20 and 30 and the web without requiring particularly high steam-supply pressures.

The location of the steam box 70 in connection with the suction roll 35 is most advantageous in that in such case the steam will spread to the environment to the lowest extent. Although only one steam box 70, 71, 72, 73 has been described as being used in connection with each embodiment of the press section, it will be understood that if desired, several steam boxes may also be used. For example, in the embodiment of FIG. 1, a steam box may also be arranged between the nips $N_2$ and $N_3$. Alternatively, it is also possible to use a radiation heater, e.g., an infrared heater, at this position.

If desired, variable crown rolls may be used in the press nips of the press section in accordance with the invention. The use of such crown rolls is possible in several different positions due to the fact that in the press section of the invention, no press-suction rolls are used. Thus, the press rolls in the press section of the invention usually comprise solid-mantle rolls which can be readily provided with known equipment for varying the crown of the roll. In particular, the press roll 51 in the third press nip $N_3$ is preferably provided as a variable crown roll.

In accordance with the present invention, the web W is turned on the suction roll 35 or on the hollow-faced press roll 35', 31' and 31'', downwardly in the direction of gravitation which also serves to promote the adherence of the web on the face of the second felt 30 against the effects of centrifugal forces. This is particularly important in the embodiments of FIGS. 5, 6 or 8 wherein the rolls 35' and 31'' are not provided with any suction effects. The web will also reliably follow the correct felt through the various parts of the press section by, for example, providing suitable different diameters for the various rolls as well as suitable respective hardnesses for the roll coatings or by any other means known in the art.

It is an important feature of the invention that the suction rolls used in the press section, if any, are either completely unloaded or are loaded only with a low load in the case of the transfer nip $N_s$. Thus, in the transfer nip the line pressure is usually as low as about 10 to 30 kN/m. On the other hand, the line pressures of the dewatering nip $N_2$, $N_2$, and $N_3$ are on the order of about 60 to 140 kN/m. The nip loading preferably increases gradually as the web moves forwardly through the press section.

A typical preferred example of nip loadings of a press section in accordance with the present invention used in a newsprint machine is as follows: $N_1=60$ kN/m, $N_2=80$ kN/m and $N_3=110$ kN/m.

As noted above, a favorable loading for the central roll 40, which usually comprises a granite or stone roll, is obtained when the nips $N_2$ and $N_3$ are situated substantially symmetrically, or at angles $\beta$ and $\gamma$ which are chosen to be proportional to the respective nip loadings, beneath the horizontal plane passing through the axis of the central roll 40. The press rolls 36 and 51 receive much of the weight of the roll 40. By way of example, the weight of a stone roll 40 of a wide newsprint machine will correspond to a nip load of up to about 80 kN/m.

Referring now to FIG. 2A, an example of a typical frame construction used in a press section in accordance with the present invention will be described. The frame construction, generally designated 100, is provided on both sides of the press section and comprises horizontal beams 101 and 102 between which vertical beams extend. The floor level of the machine is designated 103 and the floor level of the underlying basement is designated 104. Guide rolls 25 are provided with conditioning devices 24 for the first fabric 20. The pick-up roll 24 is journaled so as to be pivotable on articulated shafts 26 by means of actuating means 27 to be pressed against the fabric 10. In a similar manner, the upper roll 21 of the first press nip $N_1$ and the following guide roll 23 of the first fabric 20 are journaled on the frame components which are mounted by means of articulated shafts 28 to the frame 100 so as to be pivotable by means of power means 29. The press roll 31 is mounted to bearing supports which are fixedly attached to the frame 100. The central roll 40 is also mounted with a fixed axis to the frame 100 whereas the rolls 36 and 51 forming the second and third nips $N_2$ and $N_3$ are mounted to bearing supports which are connected to articulated shafts 39 and 51 so as to be pivotable by actuating means **39*a* and 56, respectively. The pressure in the nips $N_2$ and $N_3$ is also produced by means of the actuating means 39*a* and 56. The second fabric 30 and the fabric 50 of the third nip $N_3$ are passed by means of guide rolls 33 and 53, respectively, into the basement space where the conditioning devices 38, 54** of these fabrics are also located in a known manner.

In connection with the guiding of the end of the web to the drying section, a detaching doctor 42 is used. The broke can be removed from the central roll 40 by means of a conventional broke removing device 44, such as a conveyor screw type device.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a paper machine including a forming section having a forming wire on which a web is dewatered in a first direction through the one of its two faces which contacts the forming wire, a closed press section following the forming section in the direction of travel of the web, comprising:

a first upper fabric on which a web from the forming wire of the wire section of the paper machine is carried, a first double-felted press nip constituted by two hollow-faced rolls through which said first upper fabric and web pass, a second lower fabric passing through said frist press nip which carries the web after said first press nip, the web being dewatered in said first press nip through both of its faces, a smooth-faced central roll constituting one roll of at least two single-felt nips, said second lower fabric extending to the smooth-face central roll so that the web is carried on said second lower fabric from said first press nip to said smooth-faced central roll and being detached from said second lower fabric asnd adhering to the face of said smooth-faced central roll to move therewith into a next one of said single-felt nips which is provided with its own press fabric, and wherein said press section is devoid of any press rolls of the suction type, said hollow-faced rolls constituting said first double-felted press nip comprising solid-mantle hollow-faced rolls;

said second web-carrying lower fabric having a run prior to a first one of asid single-felt nips which is turned in a downward direction over a peripheral sector of a roll sitauted within a loop of said second lower fabric, said peripheral sector having a magnitude in the range of about 30° to 160° ; and wherein the web passes through said first double-felted press nip and said at least two single-felt nips so that the face of the web which did not contact the forming wire of the wire section contacts the smooth face of said central roll in said at least two single-felt press nips and so that the web is dewatered in said at least two single felt nips in said first direction through said one of the web faces which contacts the forming wire in the forming section.

2. The combination of claim 1 wherein said roll situated within a loop of said second lower fabric over said peripheral sector of which the web is turned in a downward direction comprises a hollow-faced press roll.

3. The combination of claim 1 wherein said roll which is situated within said loop of second lower fabric over a peripheral sector of which the second web-carrying lowe fabric is turned in a downward direction is a separate hollow-faced press roll, said hollow-faced press roll forming a second press nip with said smooth-faced central roll, said second press nip constituting a first one of said at least two single-felt press nips.

4. The combination of claim 3 wherein said first single-felt press nip is located at a small angle above a horizontal plane passing through the axis of said central roll and another one of said at least two single-felt press nips is situated at an angle slightly ahead of a vertical plane passing through the axis of said central roll.

5. The combination of claim 3 wherein said second lower fabric constitutes a single felt of said second press nip formed with said smooth-faced central roll.

6. The combination of claim 3 further including guide roll means for detaching said web from said first upper fabric after a joint run of said first and second fabrics.

7. The combination of claim 3 further including guide roll means for detaching said web from said first upper fabric after a certain cover sector of one of said rolls forming said first double-felted press nip.

8. The combination of claim 1 wherein said roll which is situated within said loop of said second lower fabric over a peripheral sector of which the second we-carrying lower fabric is turned in a downward direction is a lower one of said two hollow-faced rolls of said first double-felted press nip.

9. The combination of claim 8 wherein said lower one of said two hollow-faced rolls of said first double-felted press nip also forms a second press nip with said smooth-faced central roll.

10. The combination of claim 9 wherein said second lower fabric passing through said first press nip further constitutes a single felt of said second press nip formed with said smooth-faced central roll.

11. The combination of claim 10 wherein another of said at least two-single felt nips formed with said smooth-faced central roll is situated substantially diametrically opposite said second press nip formed by said lower one of said two hollow-faced rolls of said first double-felted press nip and said smooth-faced central roll.

* * * * *